US009599127B2

(12) United States Patent
Wiens et al.

(10) Patent No.: US 9,599,127 B2
(45) Date of Patent: Mar. 21, 2017

(54) HYDRAULIC CIRCUIT SUPPLY SYSTEM

(71) Applicant: DEERE & COMPANY, Moline, IL (US)

(72) Inventors: Scott R. Wiens, Cedar Falls, IA (US); Marcus Bitter, Dortmund Benninghofen (DE); Christian Brueser, Speyer (DE); Harm-Hendrik Lange, Bockenem (DE); Helmut Schaefer, Ketsch (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/159,942

(22) Filed: Jan. 21, 2014

(65) Prior Publication Data

US 2015/0275925 A1 Oct. 1, 2015
US 2016/0169252 A9 Jun. 16, 2016

Related U.S. Application Data

(62) Division of application No. 13/255,940, filed as application No. PCT/EP2010/052833 on Mar. 5, 2010, now abandoned.

(30) Foreign Application Priority Data

Mar. 10, 2009 (DE) ..... 10 2009 001 448

(51) Int. Cl.
*F15B 1/26* (2006.01)
*F04B 23/02* (2006.01)
*F04F 1/02* (2006.01)

(52) U.S. Cl.
CPC ..... *F15B 1/26* (2013.01); *F04B 23/02* (2013.01); *F04F 1/02* (2013.01);
(Continued)

(58) Field of Classification Search
CPC .. F15B 1/26; F15B 2211/20592; F04B 23/02; F04B 23/025; F04B 23/04;
(Continued)

(56) References Cited

U.S. PATENT DOCUMENTS 4,445,829 A * 5/1984 Miller ..... F16L 55/05 137/565.34
5,335,704 A * 8/1994 Haatveit ..... G05D 9/12 137/571

(Continued)

FOREIGN PATENT DOCUMENTS

DE 2822209 C2 6/1987
DE 102007033419 A1 1/2009
DE WO 2010102957 A1 * 9/2010 ..... F15B 1/265

OTHER PUBLICATIONS

Machine Translation for WO 2020203957 A1.*

*Primary Examiner* — Mary McManmon
*Assistant Examiner* — Ian Paquette

(57) ABSTRACT

The invention relates to an system for supplying a hydraulic circuit with hydraulic fluid. The system includes a working reservoir and an auxiliary reservoir connected to the working reservoir by a hydraulic line. An air pump has an inlet connected to a suction line that opens into a liquid-free portion of the auxiliary reservoir so that a negative pressure can be built up in the auxiliary reservoir relative to the atmospheric ambient pressure. The air pump inlet is also connected to a control line, which comprises a control opening which is covered by the hydraulic fluid in the working reservoir, at least before the air pump is started up.

15 Claims, 4 Drawing Sheets

(52) U.S. Cl.
CPC . *F15B 2211/20592* (2013.01); *F15B 2211/89* (2013.01); *Y10T 137/85978* (2015.04); *Y10T 137/86019* (2015.04); *Y10T 137/86043* (2015.04); *Y10T 137/86083* (2015.04); *Y10T 137/86187* (2015.04); *Y10T 137/86348* (2015.04)

(58) Field of Classification Search
CPC ..... Y10T 137/86019; Y10T 137/85978; Y10T 137/86083; Y10T 137/86043; Y10T 137/86187; Y10T 137/86348
USPC .... 137/205, 565.01, 565.15, 565.23, 565.34, 137/571, 590
See application file for complete search history.

(56) References Cited

U.S. PATENT DOCUMENTS

| | | | | | |
|---|---|---|---|---|---|
| 5,477,882 | A * | 12/1995 | Duthie | F15B 1/26 | 137/565.19 |
| 5,770,053 | A * | 6/1998 | Chotel | F15B 21/06 | 137/240 |
| 5,775,103 | A | 7/1998 | Ingvast | | |
| 6,382,225 | B1 * | 5/2002 | Tipton | B60K 15/00 | 123/514 |
| 6,845,782 | B2 * | 1/2005 | Osterkil | B60K 15/077 | 137/1 |
| 8,151,818 | B2 * | 4/2012 | Wiens | F15B 1/26 | 137/205 |
| 2008/0173356 | A1 * | 7/2008 | Johnson | B01D 17/045 | 137/334 |

* cited by examiner

HYDRAULIC CIRCUIT SUPPLY SYSTEM

This is a divisional of application Ser. No. 13/255,940, filed 9 Dec. 2011, which is now abandoned.

FIELD OF THE INVENTION

The present disclosure relates to a system for supplying hydraulic fluid to a hydraulic circuit.

BACKGROUND OF THE INVENTION

A system of this generic type is used in of series 6030 and 7030 John Deere tractors, in which a charging oil pump continuously conveys the hydraulic fluid against the force of gravity from a working reservoir formed by a differential casing into a higher auxiliary reservoir for interim storage, wherein the hydraulic fluid is fed from the auxiliary reservoir via a controllable high-pressure pump into a hydraulic circuit for operating hydraulic vehicle units. Hydraulic fluid no longer needed by the vehicle units is conducted back into the working reservoir. The hydraulically operated vehicle units are, in particular, a steering and braking system, as well as agricultural attachments that can be mounted on the tractor and have hydraulic actuating cylinders or the like. Depending on the hydraulic fluid consumption of the vehicle units, there can be more or less pronounced fluctuations of the fluid level in the working reservoir.

Since a pressure on the order of several bar is present at the output side of the charging oil pump while it is conveying hydraulic fluid, there are also increased requirements for pressure load capabilities of the auxiliary reservoir. Due to the associated extra construction expense, these requirements lead to corresponding additional costs. If an increased withdrawal of hydraulic fluid occurs during operation of the vehicle units, there is also the possibility that the working reservoir may be completely emptied in the direction of the auxiliary reservoir due to the continuous operation of the charging oil pump, and therefore the charging oil pump may continue to run "dry" or un-lubricated. The latter may not only have a negative effect on the service life of the charging oil pump, but can also lead to an interruption of the lubrication for the differential gear unit present in the differential casing.

SUMMARY

According to an aspect of the present disclosure, a supply system provides a uniform supply of hydraulic fluid to a hydraulic circuit.

The supply system includes a working reservoir for holding the hydraulic fluid provided for operating the hydraulic circuit as well as an auxiliary reservoir, connected to the working reservoir via a hydraulic line, for interim storage of hydraulic fluid removed from the working reservoir.

In addition, an air pump is connected at its low-pressure end to a suction line issuing into a fluid-free area of the auxiliary reservoir, so that relative to the atmospheric ambient pressure, a negative pressure can be bunt up in the suction line and thus in the connected auxiliary reservoir. The air pump is also connected on the other hand to a control line having a control opening that is covered by the hydraulic fluid in the working reservoir, at least before the air pump goes into operation.

If the air pump is operated, then hydraulic fluid flows from the working reservoir via the hydraulic connection into the auxiliary reservoir, due to the negative pressure built up in the auxiliary reservoir by the suction line. In the process, the fluid level in the working reservoir decreases, with the control opening in the control line being at least partially exposed below a defined fluid level, so that the negative pressure built up in the auxiliary reservoir decreases, due to the air drawn in from the surroundings via the control line, to a level dependent on the flow resistance of the control opening. Because of the pressure drop, there is a shift in the fluid level in the direction of the control opening, so that it is again covered by hydraulic fluid. This process repeats with decreasing intensity until a corresponding equilibrium position of the fluid level in the working reservoir has been reached. In other words, the fluid columns in the two reservoirs that are connected by the hydraulic line are excited into a damped oscillation, wherein after decay of the oscillation, an equilibrium position of the fluid level in the working reservoir dependent on the position or installation level and/or the flow resistance of the control opening is adjusted or regulated.

The air pump is preferably an electrically driven vacuum pump. The air pump could alternatively be driven by the internal combustion engine of the agricultural utility vehicle, and the air pump can be connected via a V-belt to the internal combustion engine.

Such a vacuum pump is already present in John Deere tractors of the 6030 and 7030 series as a component of a hydraulic supply system for a vehicle transmission cooperating with the internal combustion engine, so that the system according to the invention can be implemented with comparatively little extra expense. Since only a slight negative pressure on the order of at most a few tenths of a bar is built up in the auxiliary reservoir, there are also no special requirements for its pressure load capabilities.

In order to reregulate the fluid level in the working reservoir both in case of an addition of hydraulic fluid and a removal thereof, it is advantageous if the hydraulic line runs between a lower area of the working reservoir and a lower area of the auxiliary reservoir, so that the hydraulic fluid can flow freely back and forth between the two reservoirs.

The suction line can either open directly into the control line, or be connected indirectly thereto. In the latter case, the control line can likewise open into the fluid-free area of the auxiliary reservoir, so that the suction line and the control line communicate with one another only indirectly and an undesired entry of hydraulic fluid drawn out of the working reservoir via the control line into the air conveyance device is prevented.

The control opening in the control line is preferably a circular or slit-shaped inlet, the latter being oriented in the longitudinal direction of the control line. In particular, the control opening can be formed in a terminal area projecting into the working reservoir, for example, by an open end of the control line. If there are several control openings, they are preferably arranged one above another in the terminal area of the control line in such a manner that they are successively exposed due to the decreasing fluid level in the working reservoir as the negative pressure builds up. The pressure drop in the control line is retarded in this case, so that the excitation of a damped oscillation of the fluid columns in the reservoirs connected via the hydraulic line is largely inhibited. This favors a more rapid adjustment or regulation of a stable equilibrium position of the fluid level in the working reservoir.

Since turbulences in the hydraulic fluid may appear during operation of the hydraulic circuit, which can lead to an undesired penetration of air into the control line, it is advantageous if the control line is surrounded by a shielding element in the area of the control opening. The shielding element is constructed or arranged in such a manner that an appearance of turbulence in the area of the control opening is largely suppressed.

In particular, the shielding element can be a cylindrical shielding tube that is closed off at its lower end by means of a fluid-permeable grating. The cylindrical shielding tube is dimensioned in such a manner that, together with the control line, it forms an annular gap open towards the top, via which the control opening can communicate with the hydraulic fluid located in the working reservoir. In case of a decreasing fluid level in the working reservoir, the hydraulic fluid can flow down through the fluid-permeable grating.

In case of an overfilling of the working reservoir with hydraulic fluid, the fluid level in the working reservoir may not decrease sufficiently after start-up of the air pump to expose the control opening due to the limited capacity of the auxiliary reservoir. In order to avoid undesired penetration of hydraulic fluid into the it pump via the suction line or the control line, it is advantageous if a throttle that reduces the negative pressure built up by means of the air pump to uncritical levels is arranged in the suction line and/or the control line.

In place of the throttle, it is possible to provide a check valve or a float valve that is closed in case hydraulic fluid penetrates. The check valve or float valve has, in particular, a movingly arranged valve ball or float that is pressed by invading hydraulic fluid against the valve seat in such a manner that an undesired flow of hydraulic fluid is suppressed. By means of the float comprised by the float valve, it is additionally possible to actuate a ball valve for creating a pressure equalization connection between the low-pressure side of the air pump and the working reservoir.

At low operating temperatures and with the consequent increased viscosity of the hydraulic fluid, it is possible that after start-up of the air pump, the hydraulic fluid in the control line cannot flow off in the direction of the working reservoir and the fluid level in the working reservoir consequently cannot assume a stable equilibrium position. This can ultimately lead to overfilling of the auxiliary reservoir and therefore the penetration of hydraulic fluid via the suction line into the connected air pump. It is therefore advantageous to provide a throttle in the control line that issues into a fluid-free area of the working reservoir and reduces the negative pressure built up by means of the air pump in the suction line to noncritical levels.

In addition, a pressure limitation valve can be arranged between the throttle and the air pump or the check valve or float valve and the air pump in such a manner that the valve becomes transmissive when a predetermined negative pressure is exceeded and creates a pressure equalization connection between the low pressure side of the air pump and the working reservoir. The pressure limitation valve is arranged for this purpose either directly in a fluid-free area of the working reservoir or connected thereto via a pressure equalization line. In the latter case, the pressure equalization valve is preferably arranged outside the working reservoir. In particular, the pressure limitation valve is a conventional spring-loaded one-way valve.

DETAILED DESCRIPTION OF THE DRAWINGS

Figure 1:
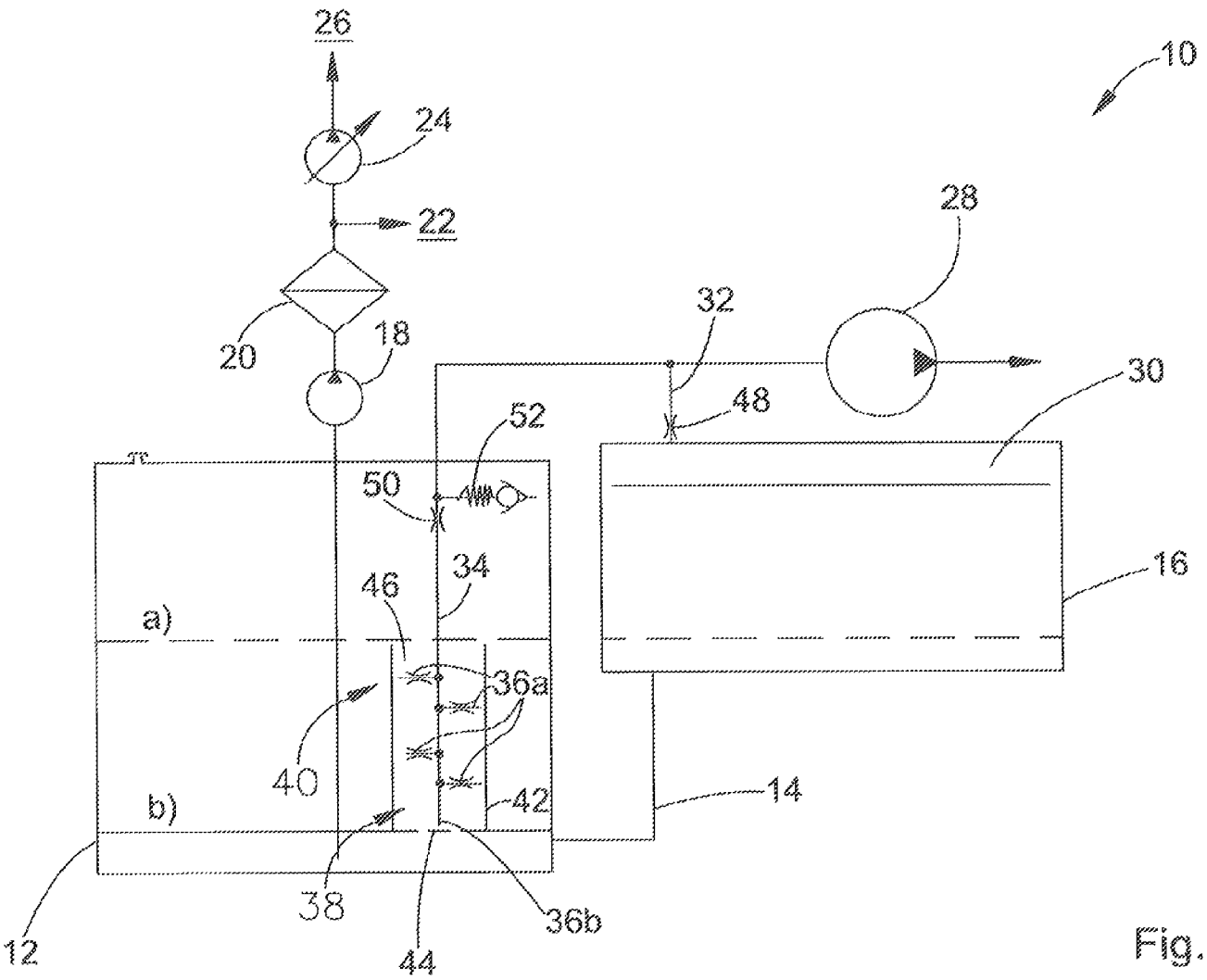
FIG. 1 is a schematic diagram of a first embodiment of a hydraulic supply system according to the invention.

Referring to FIG. 1, a supply system 10 supplies hydraulic fluid to an hydraulic, circuit of an agricultural utility vehicle (not shown). The agricultural utility vehicle may be, for example, a tractor, a harvester, a forage chopper or a spraying machine.

The system 10 is preferably located in the engine compartment or the area of the transmission assembly of the agricultural utility vehicle. The system 10 includes a working reservoir 12 for holding the hydraulic fluid provided for operating the hydraulic circuit and an auxiliary reservoir 16. The auxiliary reservoir 16 is connected to the working reservoir 12 via a hydraulic line 14, for interim-storing or buffering hydraulic fluid removed from the working reservoir 12.

The working reservoir 12 is constructed, for example, as a differential casing for a differential gear unit comprised by the agricultural utility vehicle The hydraulic fluid in the differential casing simultaneously constitutes a sump for lubricating the differential gear unit. The hydraulic fluid is a conventional hydraulic or transmission fluid.

In order to allow a free flow of hydraulic fluid back and forth between the two reservoirs 12 and 16, the hydraulic line 14 runs between a lower area of the working reservoir 12 and a lower area of the auxiliary reservoir 16. The auxiliary reservoir 16 is elevated with respect to the working reservoir 12, and the hydraulic line 14 is connected to an underside of the auxiliary reservoir 16 so that the auxiliary reservoir 16 can be completely emptied into the working reservoir 12.

The hydraulic fluid is supplied by a charge oil pump 18 via an interpolated oil filter 20 to an internal combustion engine 22 of the vehicle, as well as to additional power transmitting components for the purpose of lubrication. A controllable high-pressure pump 24 downstream of the oil filter 20 supplies hydraulically operated vehicle unit 26 such as a steering and braking system or an implement that can be attached to the agriculture utility vehicle and has hydraulic actuating cylinders or the like. Hydraulic fluid that is no longer needed or is in surplus is conducted back to the working reservoir 12 via lines, not shown.

An air pump 28 has a low-pressure or inlet side which is connected to a suction line 32 issuing into a fluid-free area 30 of the auxiliary reservoir 16 and which is connected to a control line 34 having several identical control openings 36*a* constructed as throttles as well as a control opening 38*b* formed by a downwardly open end of the control line 34. This creates a negative pressure relative to the ambient atmospheric pressure in the auxiliary reservoir 16. The control openings 36*a* and 36*b* are completely covered by the hydraulic fluid in the working reservoir 12, at least before start-up of the air pump 28, before build-up of the negative pressure in the auxiliary reservoir 16. This situation is indicated by the fluid level labeled a) in FIG. 1.

If the air pump 28 is started up, then hydraulic fluid flows tram the working reservoir 12 against the force of gravity into the auxiliary reservoir 16 via hydraulic line 14 due to the negative pressure built up in the auxiliary reservoir 16. In the process, the fluid level in the working reservoir 12 decreases, so that the control openings 36*a* and then the control op opening 36*b* are successively exposed and the negative pressure built up in the suction line 32 falls due to the air drawn in via the control line 34 from the environment to a value that is dependent on the flow resistance of the exposed control openings 36*a* and 38*b* and leads to the regulation or control of an equilibrium position of the fluid level in the working reservoir 12. This situation is illustrated by the fluid level labeled b) in FIG. 1.

The control openings 36*a* and 36*b* are arranged one above another in a terminal area 38 of the control line 34 projecting into the working reservoir 12. The control openings 36*a* are constructed in the control line 34 as circular or slit-shaped inlets, the latter being oriented in the longitudinal direction of the control line 34. The control opening 36*b* formed by the open end of the control line 34 typically has the diameter on the order of 25 mm.

It may be noted at this point that the representation of several control openings 36*a* and 36*b* has only an exemplary character. Alternately, it is also conceivable to provide only a single control opening 36*b* in the form of a downwardly open end of the control line 34.

The air pump 28 is a vacuum pump of conventional construction driven by the internal combustion engine 22 of the vehicle. It creates a negative pressure on the order of typically 50 mbar in the auxiliary reservoir 16.

According to an advantageous refinement of the invented system 10, the control line 34 is surrounded in the area of the control openings 36*a* and 36*b* by a shielding element 40. The shielding element 40 is a cylindrical shielding tube 42 that is closed off at its lower end by means of a fluid-permeable grating 44. The cylindrical shielding tube 42 is dimensioned so that, together with the control line 34, it forms an annular gap 46 open towards the top, via which the control openings 36*a* and 36*b* can communicate with the hydraulic fluid located in the working reservoir 12.

In case the working reservoir 12 is overfilled with hydraulic fluid, there is a possibility that the fluid level in the working reservoir 12 may not decrease sufficiently after start-up of the air pump 28 to expose the control openings 36*a* and the control opening 36*b* in particular, due to the limited capacity of the auxiliary reservoir 16. In order to prevent an undesired penetration of hydraulic fluid into the suction line 32 or the control line 34, and thus ultimately into the air pump 28, a throttle or restriction 48, 50 arranged in the suction line 32 and control line 34, respectively, increases the negative pressure built up by the air pump 28 sufficiently when fluid enters, that a pressure limitation valve 52 connected between the throttle 50 and the air pump 28 becomes transmissive when a predetermined negative pressure is exceeded and creates a pressure equalization connection between the low-pressure side of the air pump 28 and the working reservoir 12. The pressure limitation valve 52 is arranged for this purpose directly in a fluid-free area of the working reservoir 12. The pressure limitation valve 52 is a conventional spring-loaded one-way valve.

Figure 2:
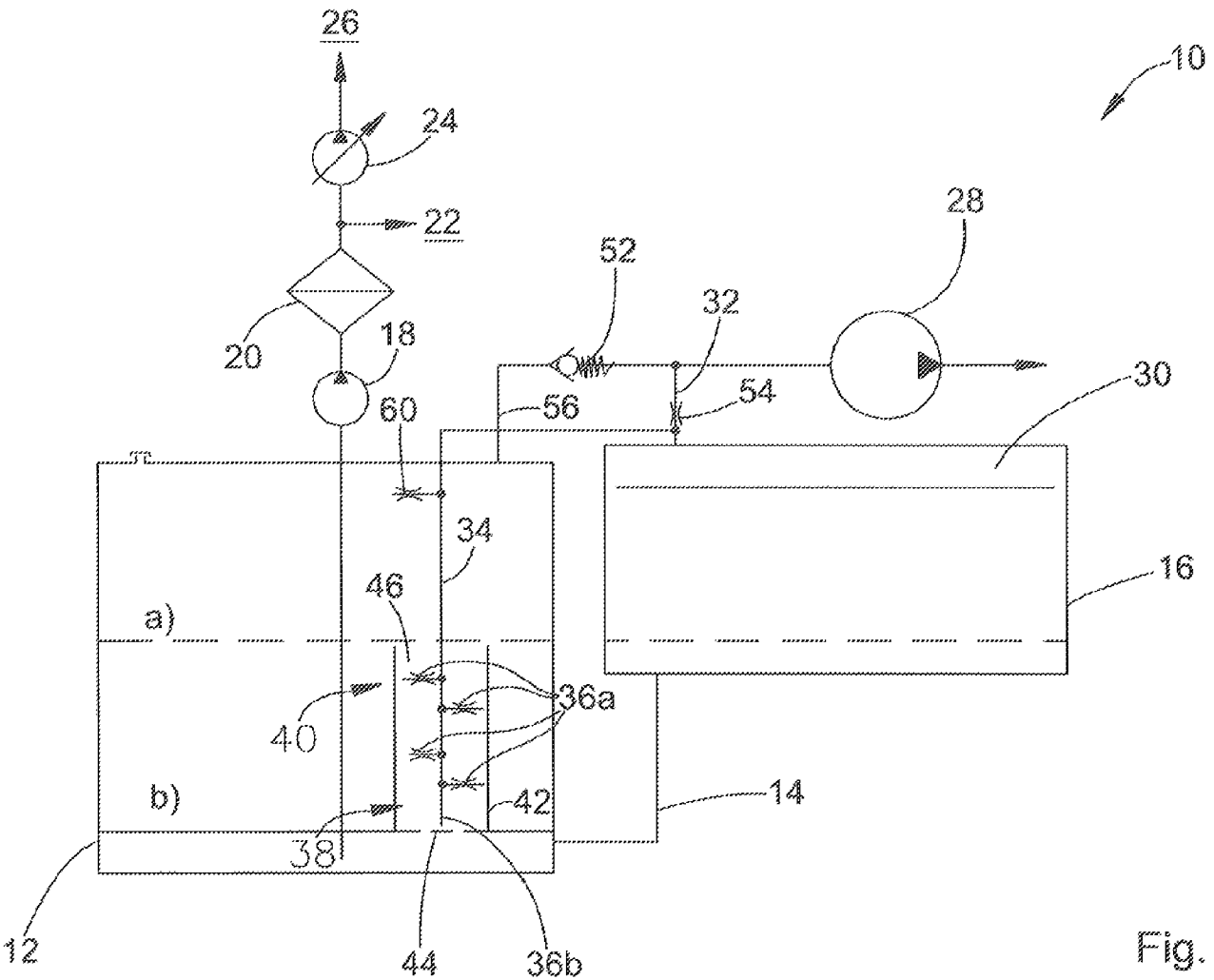
FIG. 2 is a schematic diagram of a second embodiment of a hydraulic supply system according to the invention.

Referring now to FIG. 2, a second exemplary embodiment of the system differs from the first exemplary embodiment of FIG. 1 in the sense that only a single throttle 54 is provided in place of the two throttles 48 and 50. The pressure limitation valve 52 is arranged in this case outside the working reservoir 12 and connected to it via a pressure equalization line 56.

At low operating temperatures and with the consequent increased viscosity of the hydraulic fluid, it is possible that after start-up of the air pump 28, the hydraulic fluid in the control line 34 cannot flow off in the direction of the working reservoir 12 and the fluid level in the working reservoir 12 consequently cannot assume a stable equilibrium position. This can ultimately lead to overfilling of the auxiliary reservoir 16 and therefore the penetration of hydraulic fluid via the suction line 32 into the connected air pump 28. Therefore a throttle 60 issuing into a fluid-free area of the working reservoir 12 is optionally provided in the control line 34 and, in connection with the pressure limitation valve 52 (comparable to the throttle 54), prevents an excessive negative pressure from being built up in the suction line 32 when the air pump 28 starts up at low operating temperatures with a consequently increased viscosity of the hydraulic fluid. The flow resistance of the throttle 60 is dimensioned such that a sufficient negative pressure can be built up in the suction line 32 connected to the control line 34, and therefore in the auxiliary reservoir 16, at normal operating temperatures.

Figure 3:
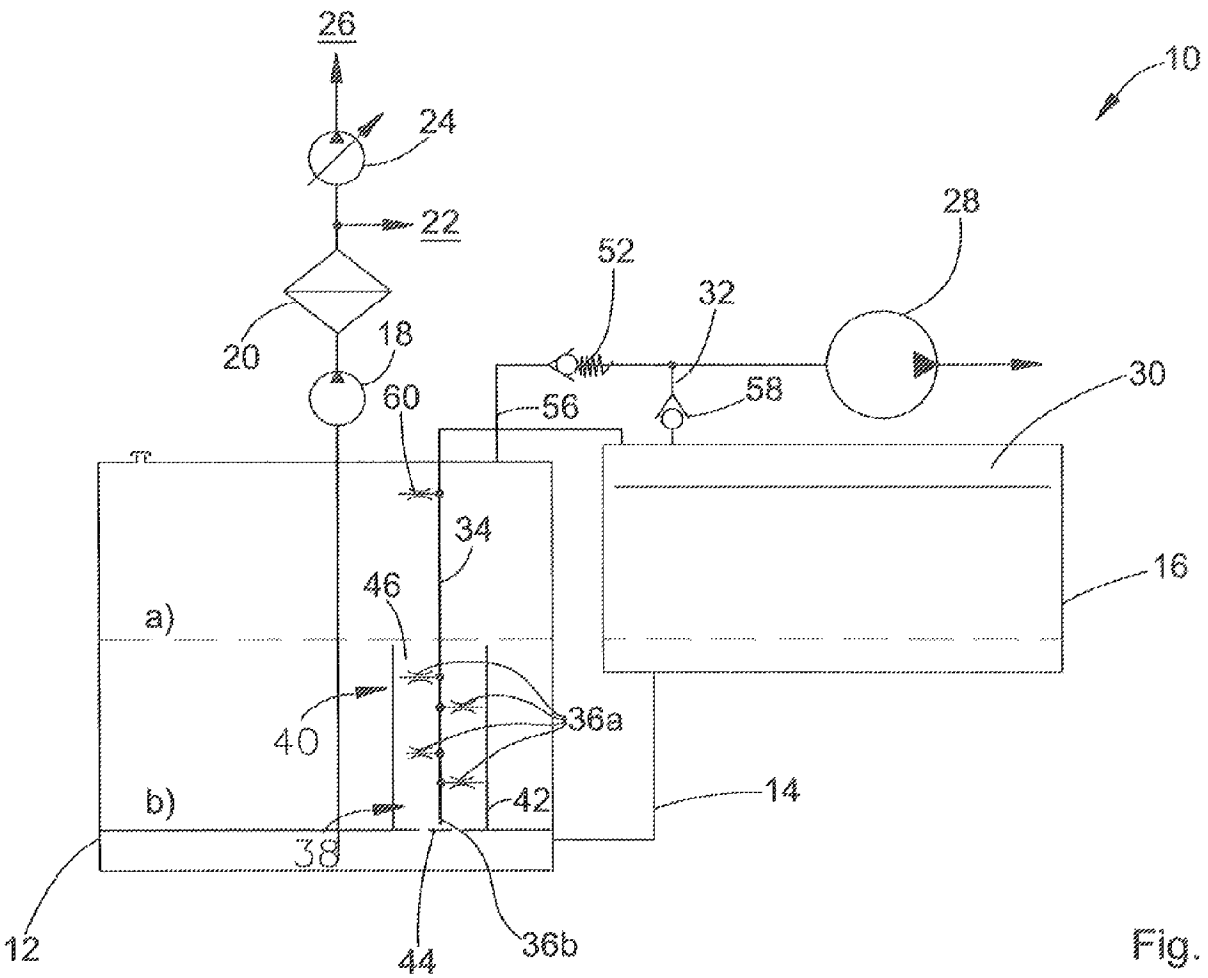
FIG. 3 is a schematic diagram of a third embodiment of a hydraulic supply system according to the invention.

Referring now to FIG. 3, a third exemplary embodiment of the system differs from the second embodiment of FIG. 2 in that a check valve 58 is provided in place of the throttle 54 and is arranged such that it is closed in case of penetrating hydraulic fluid. The check valve 58 has, in particular, a movingly arranged valve ball that is pressed by invading hydraulic fluid against the valve seat so that an undesired flow of hydraulic fluid is suppressed.

In contrast to the two previous exemplary embodiments, the suction line 32 does not open directly into the control line 34. Instead there is only an indirect connection between the suction line 32 and the control line 34. For this purpose, the control line 32 likewise opens directly into the fluid-free area 30 of the auxiliary reservoir 16. An additional protection from an undesired penetration of hydraulic fluid drawn in from the working reservoir 12 via the control line 34 into the air pump 28 connected to the suction line 32 is provided, since the two lines 32 and 34 communicate only indirectly with one another in this case. For example, the suction line 32 and the control line 34 are connected at the upper side of the auxiliary reservoir 16.

Figure 4:
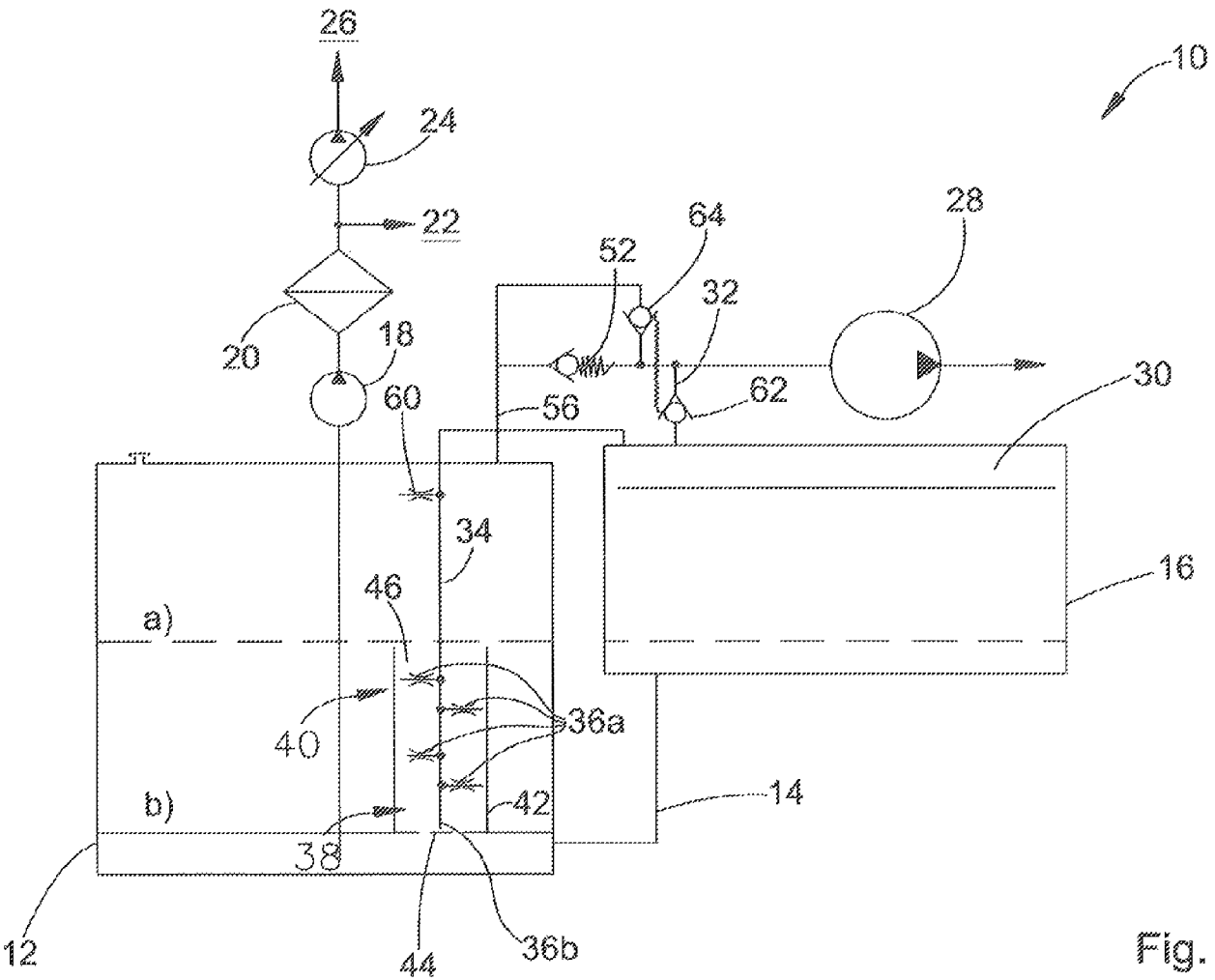
FIG. 4 is a schematic diagram of a fourth embodiment of a hydraulic supply system according to the invention.

Referring now to FIG. 4, a fourth embodiment of the system differs from the third embodiment of FIG. 3 in the sense that, in place of the check valve 58, a float valve 62 is provided, whose float is pressed against a valve seat by penetration of hydraulic fluid to such an extent that the connection to the auxiliary reservoir 16 via the suction line 32 is interrupted and at the same time a pressure equalization connection is created between the low-pressure side of the air pump 28 and the working reservoir 12 by actuation of a ball valve 64 connected to the float, bypassing the pressure limitation valve 52.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. A supply system for supplying a hydraulic circuit with hydraulic fluid, comprising:

a working reservoir for holding hydraulic fluid for operating the hydraulic circuit;

an auxiliary reservoir, connected to the working reservoir via a hydraulic line, the auxiliary reservoir providing interim storage of hydraulic fluid removed from the working reservoir;

an air pump, the air pump having an inlet connected to a suction line issuing into a fluid-free area of the auxiliary reservoir, so that relative to atmospheric ambient pressure, a negative pressure can be built up in the auxiliary reservoir, and the air pump inlet also being connected to a control line having a control opening which is covered by the hydraulic fluid in the working reservoir, at least before the air pump goes into operation; and a float valve is arranged in the suction line.

2. The supply system of claim 1, wherein:

the hydraulic line runs between a lower portion of the working reservoir and a lower portion of the auxiliary reservoir.

3. The supply system of claim 1, wherein:

the suction line is directly connected to the control line.

4. The supply system of claim 1, wherein:

the control opening comprises a throttle.

5. The supply system of claim 1, wherein:

the float valve includes a float which actuates a ball valve to produce a pressure equalization connection between the low-pressure side of the air pump and the working reservoir.

6. The supply system of claim 1, wherein:

a throttle communicates the control line into a fluid-free area of the working reservoir.

7. The supply system of claim 1, wherein:

a pressure limitation valve is connected to the control line between a throttle and the air pump, to equalization pressure between the low-pressure side of the air pump and the working reservoir.

8. The supply system of claim 1, wherein:

a pressure limitation valve is connected to the inlet of the air pump.

9. The supply system of claim 1, wherein:

a pressure limitation valve and the float valve are connected to the inlet of the air pump.

10. The supply system of claim 1, wherein:

a throttle is arranged in the control line.

11. The supply system of claim 1, wherein:

the control opening is formed in a terminal portion of the control line projecting into the working reservoir.

12. The supply system of claim 11, wherein:

several control openings are formed in the terminal portion of the control line projecting into the working reservoir, wherein the control openings are arranged one above another.

13. The supply system of claim 1, wherein:

the control line is surrounded in the area of the control opening by a shielding element.

14. The supply system of claim 13, wherein:

the shielding element is a cylindrical shielding tube and a fluid-permiable grating is mounted in a lower end of the cylindrical shielding tube.

15. The supply system of claim 13, wherein:

the shielding element is a cylindrical shielding tube and the cylindrical shielding tube and the control line cooperate to form an upwardly opening annular gap, the gap communicating the control opening with hydraulic fluid in the working reservoir.

* * * * *